US007874039B2

(12) United States Patent
Lin

(10) Patent No.: US 7,874,039 B2
(45) Date of Patent: Jan. 25, 2011

(54) DUST COLLECTOR HAVING DUST BAG-EXPANDING FUNCTION

(75) Inventor: Kun-Yen Lin, Taichung County (TW)

(73) Assignee: Meta International Co., Ltd., Taichung County (TW)

( * ) Notice: Subject to any disclaimer, the term of this patent is extended or adjusted under 35 U.S.C. 154(b) by 724 days.

(21) Appl. No.: 11/979,017

(22) Filed: Oct. 30, 2007

(65) Prior Publication Data

US 2009/0106931 A1 Apr. 30, 2009

(51) Int. Cl.
*A47L 9/10* (2006.01)
*B01D 51/00* (2006.01)

(52) U.S. Cl. ..... 15/320; 55/356; 55/366; 55/367; 55/368; 55/369; 55/372; 55/373; 55/413; 55/467; 55/482; 15/347; 15/353; 15/DIG. 8

(58) Field of Classification Search ..... 55/356, 55/366–369, 371–373, 378, 320, 413, 467, 55/429, 482; 15/347, 353, DIG. 8; *A47I 9/10; B01D 51/00*

See application file for complete search history.

(56) References Cited

U.S. PATENT DOCUMENTS

| | | | | |
|---|---|---|---|---|
| 4,204,846 | A * | 5/1980 | Brenholt | 96/425 |
| 4,921,510 | A * | 5/1990 | Plooy | 55/288 |
| 5,169,420 | A * | 12/1992 | Chen | 55/315 |
| 7,044,991 | B2 * | 5/2006 | Wang | 55/366 |
| 7,260,868 | B2 * | 8/2007 | Cheng | 15/347 |

* cited by examiner

*Primary Examiner*—David A Redding
(74) *Attorney, Agent, or Firm*—Muncy, Geissler, Olds & Lowe, PLLC

(57) ABSTRACT

The present invention discloses a dust tank is arranged in the lower side of the machine frame. A dust bag is sleeved by the dust tank. The top side of the dust tank is connected to a filter tank. The filter tank has an air inlet pipe at the bottom side thereof, a filter thereinside, and an air outlet at the top side thereof. The air outlet is connected to a closed chamber arranged at the other side of the machine frame via the air suction pipe. A suction blower is arranged inside the closed chamber. A motor drives the suction blower to operate and suck air to flow through the air suction pipe and go out from through-holes on the top of the closed chamber.

7 Claims, 4 Drawing Sheets

DUST COLLECTOR HAVING DUST BAG-EXPANDING FUNCTION

FIELD OF THE INVENTION

The present invention relates to a dust collector, particularly to a dust collector, which can automatically expand the dust bag to benefit receiving falling waste.

BACKGROUND OF THE INVENTION

When lumber is sawed into pieces or fabricated into a specified shape in a wood mill, a great amount of wood debris and wood dust is generated. The floating wood debris and wood dust will contaminate the air and harm the health of the workers. Therefore, wood mills generally have large-size dust collectors. Refer to FIG. 1 for a conventional dust collector. The upper side of the conventional dust collector has a motor 1 with a fan (not shown in the drawing) therebelow. The conventional dust collector has an air inlet pipe 2. When the motor 1 drives the fan to rotate, external air is sucked to enter the air inlet pipe 2 and pass through an inner filter. Thus, wood debris and wood dust is filtered out by the filter. The conventional dust collector has a dust tank 3 at the lower-left side thereof. A plastic bag 4 is arranged inside the dust tank 3 to receive wood debris and wood dust. The air having passed through the filter is guided to a filter tank 5 at the right side and then goes out from the dust collecting bag 6 below the filter tank 5, wherein the dust collecting bag 6 can filter out smaller particles.

The motor 1 drives the fan to rotate and generates an intense suction force, which sucks external air into the conventional dust collector. However, the suction force also sucks the plastic bag 4 and makes the plastic bag 4 hard to expand. Therefore, there should be a brace to support the plastic bag 4. However, the suction force will still draw up the plastic bag 4 and thus tear holes on the plastic bag 4.

SUMMARY OF THE INVENTION

The primary objective of the present invention is to provide a dust collector having a dust bag-expanding function, which comprises: a machine frame, a suction blower, a dust tank, a filter tank, an air suction pipe, and a hose. The dust tank is vertically arranged at one side of the machine frame; a closed chamber is arranged at the other side of the machine frame. A dust bag is sleeved by the dust tank. The top side of the dust tank is connected to the filter tank. The filter tank has an air inlet pipe horizontally arranged at the bottom side thereof, a filter vertically arranged thereinside, and an air outlet horizontally arranged at the top side thereof. The air outlet is connected to the closed chamber arranged at the lower side of the machine frame via the air suction pipe. The suction blower arranged inside the closed chamber. A motor drives the suction blower to operate and suck air to flow through the air suction pipe and go out from through-holes on the top of the closed chamber. The improvement of the present invention is that the hose interconnects the dust tank and the air suction pipe. Thereby, the suction force of the suction blower can suck away the air between the dust bag and the dust tank. Thus, the dust bag will automatically expand and adhere to the inner wall of the dust tank.

DETAILED DESCRIPTION OF THE PREFERRED EMBODIMENTS

Figure 1:
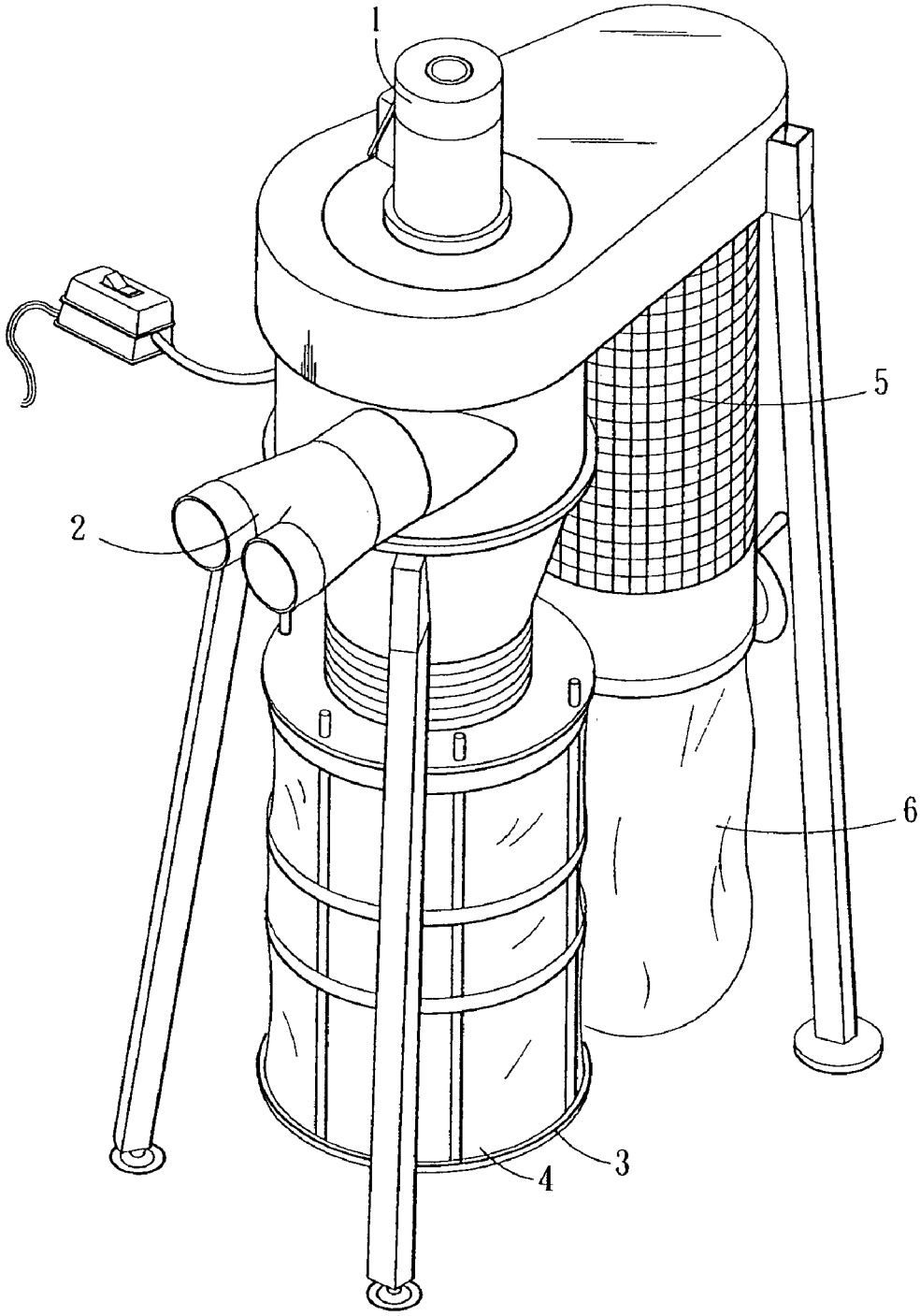
Fig. 1 PRIOR ART
FIG. 1 is a perspective view showing a conventional dust collector.
Figure 2:
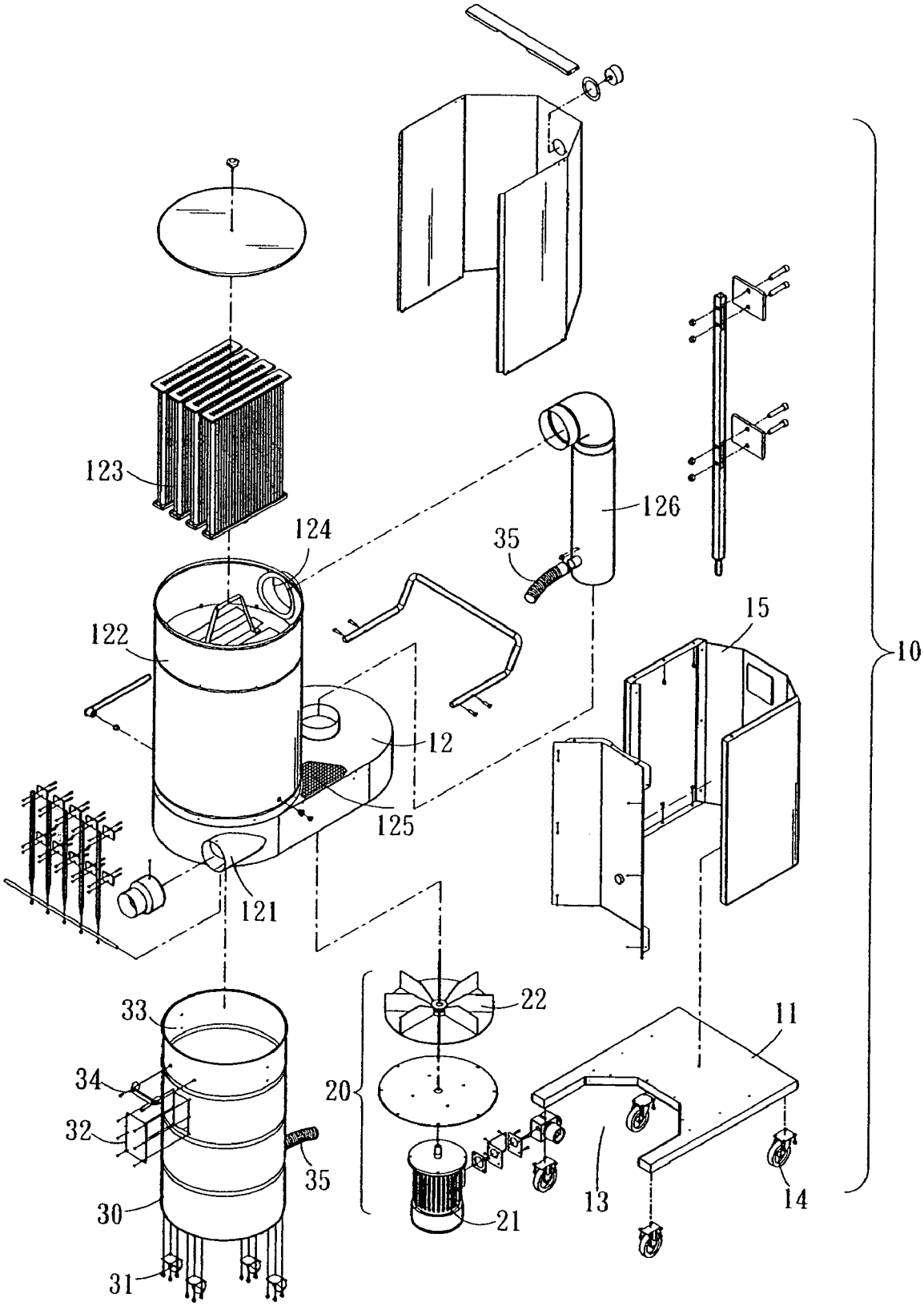
FIG. 2 is an exploded view schematically showing one preferred embodiment of the present invention.
Figure 3:
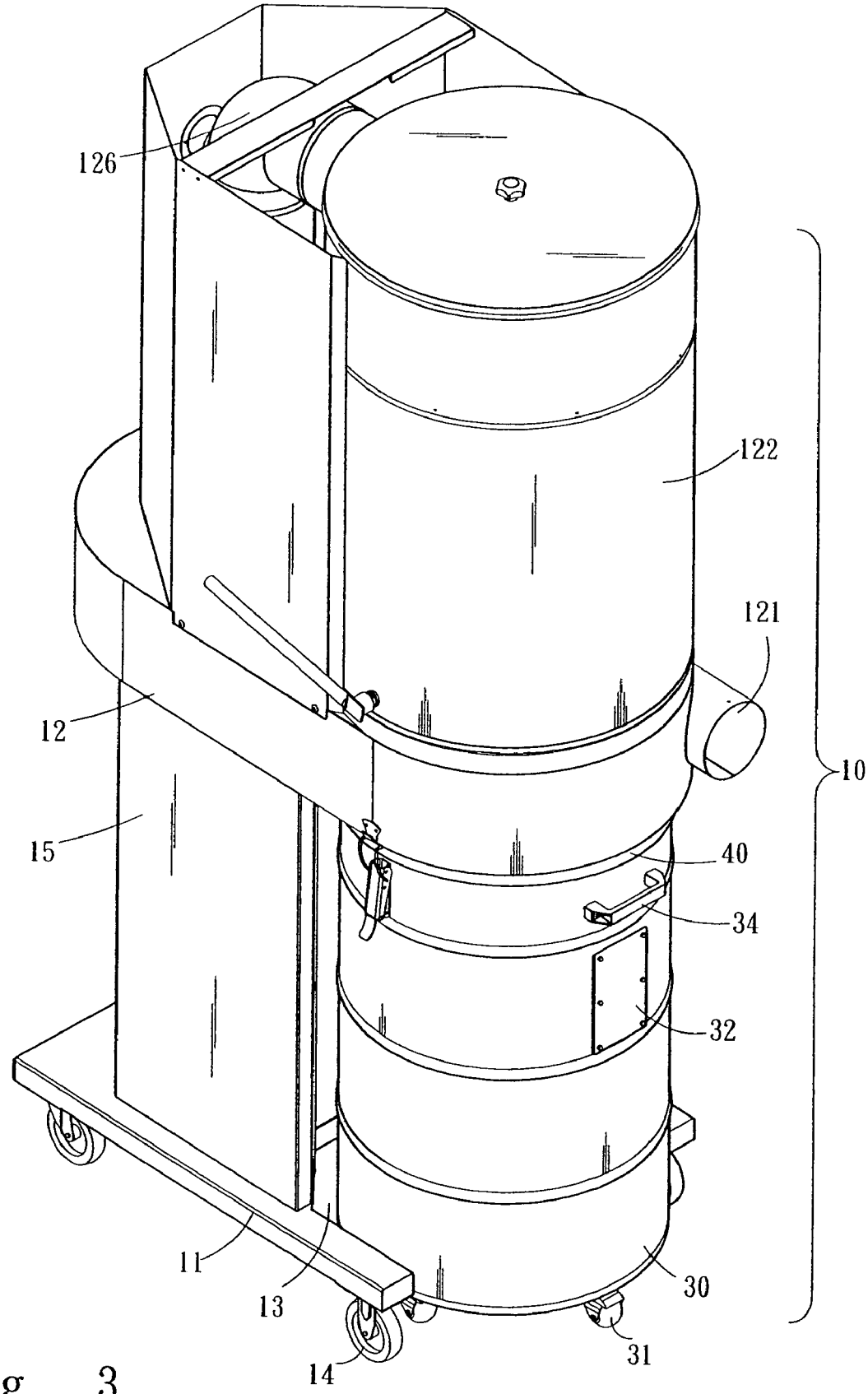
FIG. 3 is a perspective view schematically showing one preferred embodiment of the present invention.

Refer to FIG. 2 and FIG. 3. The dust collector having a dust bag-expanding function of the present invention comprises: a machine frame 10, a suction blower 20, a dust tank 30, a filter tank 122, an air suction pipe 126, and a hose 35.

The machine frame 10 has a rectangular bottom plate 11. A hollow elliptic-shape platform 12 is arranged above the bottom plate 11. One side of the bottom plate 11 has a U-shape opening 13. Four wheels 14 are respectively arranged at four corners of the bottom plate 11. Four wall plates over the bottom plate 11, together the bottom plate 11, form a closed chamber 15 (Refer to FIG. 4 also).

Figure 4:
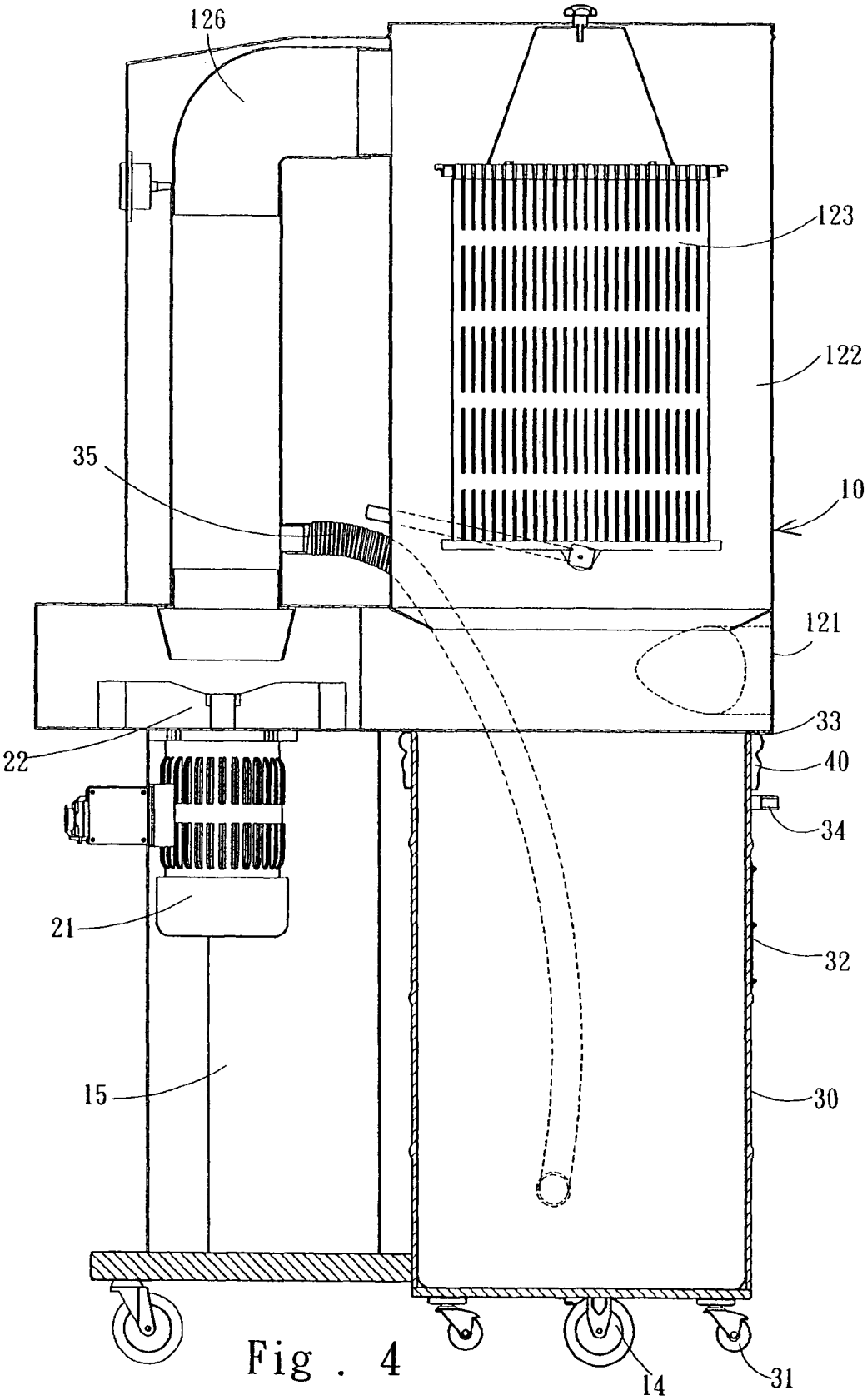
FIG. 4 is a sectional view schematically showing one preferred embodiment of the present invention.

The suction blower 20 is arranged inside the closed chamber 15. The suction blower 20 includes a motor 21, as shown in FIG. 4. The motor 21 is vertically fastened to an internal wall of the closed chamber 15. The motor 21 has a driving shaft at the top thereof A fan 22 is arranged inside the platform 12. The driving shaft is coupled to the center of the fan 22 and drives the fan 22 to rotate.

The dust tank 30 has an upper opening 33. The dust tank 30 has a cylindrical shape and is arranged inside the U-shape opening 13 of the bottom plate 11. The dust tank 30 has four wheels 31 at the bottom thereof, a transparent window 32 at the wall thereof and a handle 34 above the window 32. The top opening 33 of the dust tank 30 is sleeved by a bottom opening of the platform 12; thus, the dust tank 30 interconnects the interior of the hollow platform 12.

The vertical wall of the platform 12 has an air inlet pipe 121 interconnecting the bottom opening of the platform 12. The top of the platform 12 has the hollow cylindrical-shape filter tank 122. The top of the filter tank 122 is closed, and the bottom opening of the filter tank 122 interconnects the interior of the platform 12. A filter 123 is arranged inside the filter tank 122. An air outlet 124 is arranged at the vertical wall near the top of the filter tank 122. The air outlet 124 is positioned above the filter 123. Besides, several through holes 125 are formed on the top of the platform 12.

The inverted-L shape air suction pipe 126 is connected to the air outlet 124 of the filter tank 122 at one end thereof and connected to the interior of the platform 12 at the other end thereof.

The hose 35 is connected to the wall of the dust tank 30 at on end thereof and connected to the air suction pipe 126 at the other end thereof.

In application, a dust bag 40, such as a transparent plastic bag, is placed inside the dust tank 30, and the upper edge of the dust bag 40 may be folded to ride on the top rim of the dust tank 30. Once the suction blower 20 is started, the air inside the air suction pipe 126 will be sucked into the closed chamber 15, and the external dirty air will be sucked to enter the air inlet pipe 121, pass through the platform 12 and then run upward to the filter 123 of the filter tank 122. Next, the air flows through the air outlet 124 at the wall of the filter tank 122 and the air suction pipe 126, runs down into the closed chamber 15 and finally goes out from the through holes 125 on the top of the platform 12. Thereby, the external dirty air is continuously sucked to pass through the filter 123 of the filter tank 122 for removing wood debris and wood dust. Thus, air is purified.

It should be particularly mentioned that the hose 35 interconnects the dust tank 30 and the air suction pipe 126 in the present invention. When the suction blower 20 sucks air from the air suction pipe 126, it also sucks away the air between the dust bag 40 and the dust tank 30 via the hose 35. Thus, the dust bag 40 inside the dust tank 30 is sucked to automatically expand and adhere to the inner wall of the dust tank 30. The dust and debris filtered out by the filter 123 inside the filter tank 122 can thus easily fall into the dust bag 40.

Besides, a user can learn the amount of the accumulated waste in the dust tank 30 via the window 32. When waste is accumulated to a considerable amount, the user can hold the handle 34 to pull the dust tank 30 having four wheels 31 therebelow away from the machine frame 10. Then, he can easily remove waste via lifting up the dust bag 40. Further, the machine frame 10 also has four wheels 14 therebelow. Thus, the dust collector can be easily and conveniently moved to a location needing it.

The samples of the present invention have been fabricated according to the specification and drawings and tested many times, and the test results verify that the present invention can achieve the expected functions. Further, it has been proved via investigation that none similar product appeared in markets or documents. Therefore, the present invention indeed meets the conditions for a patent. Thus, the Inventor files a patent application for the present invention.

The preferred embodiments described above are only to exemplify the present invention but not to limit the scope of the present invention. Any equivalent modification or variation according to the spirit of the present invention is to be also included within the scope of the present invention.

What is claimed is:

1. A dust collector having a dust bag-expanding function comprising:

a machine frame having a closed chamber at one side of the bottom thereof and a hollow platform in the middle portion thereof, wherein said closed chamber has several through-holes; said platform has a bottom opening at one side thereof, and the vertical wall of said platform has an air inlet pipe interconnecting said bottom opening;

a suction blower arranged inside said closed chamber, wherein said suction blower includes a vertical motor, and the top of said motor is coupled to a fan, and said motor drives said fan to rotate;

a dust tank having an upper opening interconnecting said bottom opening of said platform;

a hollow filter tank arranged above said platform and having a filter thereinside, wherein the bottom of said filter tank interconnects the interior of said platform, and an air outlet is arranged at the vertical wall near the top of said filter tank, and said air outlet is positioned above said filter;

an air suction pipe connected to said air outlet at one end thereof and connected to said closed chamber at the other end thereof; and a hose connected to the wall of said dust tank at on end thereof and connected to said air suction pipe at the other end thereof.

2. The dust collector having the dust bag-expanding function according to claim 1, wherein said machine frame has a rectangular bottom plate, and one side of said bottom plate has a U-shape opening for accommodating said dust tank; said closed chamber is arranged at the other side of said bottom plate; four wheels are respectively arranged at four corners of said bottom plate.

3. The dust collector having the dust bag-expanding function according to claim 1, wherein said motor is vertically fastened to an internal wall of said closed chamber.

4. The dust collector having the dust bag-expanding function according to claim 1, wherein said platform has an elliptic shape; said dust tank has a cylindrical shape and has at least three wheels on the bottom thereof.

5. The dust collector having the dust bag-expanding function according to claim 1, wherein said dust tank has a transparent window at the wall thereof.

6. The dust collector having the dust bag-expanding function according to claim 5, wherein said dust tank has a handle above said window.

7. The dust collector having the dust bag-expanding function according to claim 1, wherein said air suction pipe has an inverted-L shape.

* * * * *